US009587643B1

(12) United States Patent
Mason

(10) Patent No.: US 9,587,643 B1
(45) Date of Patent: Mar. 7, 2017

(54) DRIVE SHAFT FOR MARINE WATER PUMP

(71) Applicant: Don Mason, North Kingstown, RI (US)

(72) Inventor: Don Mason, North Kingstown, RI (US)

( * ) Notice: Subject to any disclaimer, the term of this patent is extended or adjusted under 35 U.S.C. 154(b) by 816 days.

(21) Appl. No.: 13/987,471

(22) Filed: Jul. 29, 2013

(51) Int. Cl.
*F04D 29/04* (2006.01)
*F04D 29/044* (2006.01)

(52) U.S. Cl.
CPC ..... *F04D 29/044* (2013.01)

(58) Field of Classification Search
CPC ..... F04D 29/044; F04D 29/05; F04D 29/04; F04D 29/263; F04D 29/043; F04D 29/20; F16D 1/06; F01P 5/12; F01D 5/025
USPC ..... 415/122.1; 418/154
See application file for complete search history.

(56) References Cited

U.S. PATENT DOCUMENTS 5,660,536 A * 8/1997 Karls ..... F04C 5/00 418/133
6,203,302 B1 * 3/2001 Maki ..... F04C 5/00 418/154
6,309,188 B1 * 10/2001 Danner ..... F04D 29/0413 310/87
7,089,728 B2 * 8/2006 Carney ..... B23K 15/0006 148/524
8,747,082 B2 * 6/2014 Yi ..... F04D 13/0633 417/366
9,044,833 B2 * 6/2015 Holzschuh ..... B23P 15/006

* cited by examiner

*Primary Examiner* — Gregory Anderson
*Assistant Examiner* — Jason Fountain

(57) ABSTRACT

A drive shaft and improved marine water pump are disclosed. The drive shaft connects to a water pump impeller on one end and to a an accessory drive for rotating the impeller on the opposite end. The drive shaft of the present invention comprises an elongate shaft portion that includes differing sectional diameters to facilitate easy placement of the pump shaft within the marine water pump and through the marine pump bearing assembly preventing bearing assembly oil seal damage. The drive shaft further comprises a widened drive shaft tang to facilitate more secure engagement to a marine pump accessory drive and a flange rim adjacent to the pump shaft tang for improved and quicker alignment of the marine pump shaft with respect to the marine pump bearing assembly.

5 Claims, 6 Drawing Sheets

DRIVE SHAFT FOR MARINE WATER PUMP

CROSS-REFERENCE TO RELATED APPLICATIONS

This application is a continuing application claiming the benefit of U.S. application Ser. No. 11/724,116 filed 14 Mar. 2007.

BACKGROUND OF THE INVENTION

1. Field of the Invention

This invention relates to a marine water pump, and more particularly to an improved drive shaft for a marine water pump.

2. Description of the Related Art

A marine water pump is used to recirculate coolant or salt water through the cylinder block of a marine engine. The water pump is equipped with a drive shaft connected to the water pump impeller on one end thereof and a shaft tang on the opposite end connected to an accessory drive. The accessory drive includes a drive slot for engagement of the shaft tang when the water pump is fixedly mounted to the accessory drive housing. As a consequence, the impeller is rotated by the drive shaft via the rotational motion of the accessory drive.

Referring to FIGS. 1 and 1A, a prior art marine water pump drive shaft is shown and comprises a first end 10 having a slot 10A, a second end 20 having a generally rectangular pump shaft tang 20A extending outward from a rounded elongate shaft 15, the elongate shaft 15 being disposed between first end 10 and second end 20. Pump shaft tang 20A includes a flat surface 20A 1 and 20A2 that are stepped down from rounded elongate shaft 15. Slot 10A of first end 10 is adapted for coupling to the impellor of a water pump and pump shaft tang 20A is adapted for coupling to a marine accessory drive.

The marine water pump drive shaft of FIGS. 1 and 1A is prone to failure in the field and has shown to be an excessive maintenance burden for removal and replacement. In a typical environment, such as a marine vessel or boat, a failed marine pump shaft must be replaced in a short period of time. Often is the case when a pump may fail during a storm or unsteady seas requiring the pump to be changed out. It is imperative that the pump be changed out expeditiously to get the marine vessel engine underway to a safer environment. The shaft of FIGS. 1 and 1A is prone to failure due to an inferior pump shaft tang 20A design. Furthermore, the prior art pump shaft is hard to replace when failed due to its dimensioning and inability to be aligned correctly within a marine water pump during maintenance.

SUMMARY OF THE INVENTION

It is an object of this invention to provide a marine pump shaft that is less prone to failure due to inadequate coupling between the pump shaft tang and accessory drive.

It is another object of this invention to decrease the maintenance burden of replacing a failed marine pump shaft.

It is another object of this invention to provide an improved marine pump shaft comprising a flange rim adjacent to the pump shaft tang for improved and quicker alignment of the marine pump shaft with respect to the marine pump bearing assembly.

It is yet another object of the present invention to provide a marine pump shaft having an elongate shaft portion that includes differing sectional diameters to facilitate easy placement of the pump shaft within the marine water pump and through the marine pump bearing assembly preventing bearing assembly oil seal damage.

It is another object of this invention to accomplish the foregoing by the use of an improved marine pump shaft which can be easily and inexpensively manufactured and easily employed during marine pump maintenance.

Broader aspects of the invention and devices within the scope of the same will become clearer from a further reading of the specification and claims and a consideration of the drawings. These and other objects which will become apparent upon a reading of the following Specification and Claims in which an improved marine water pump shaft is disclosed.

The drive shaft of the present invention comprises an elongate shaft portion that includes differing sectional diameters to facilitate easy placement of the pump shaft within the marine water pump and through the marine pump bearing assembly preventing bearing assembly oil seal damage. The drive shaft further comprises a widened drive shaft tang to facilitate more secure engagement to a marine pump accessory drive and a flange rim adjacent to the pump shaft tang for improved and quicker alignment of the marine pump shaft with respect to the marine pump bearing assembly.

BRIEF DESCRIPTION OF THE DRAWINGS

The invention is best understood from the following detailed description when read in connection with the accompanying drawings, which illustrate an embodiment of the present invention.

DETAILED DESCRIPTION OF THE INVENTION

Figure 1:
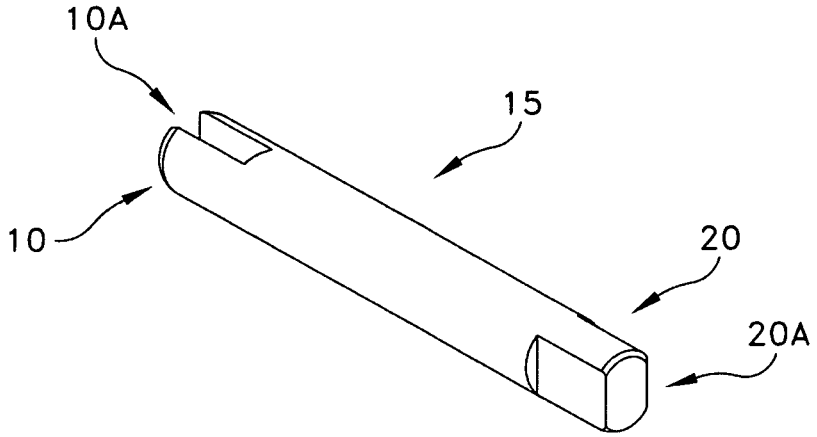
FIG. 1 (PRIOR ART)
FIG. 1 illustrates a perspective view of a prior art drive shaft for a marine water pump.
Figure 1A:
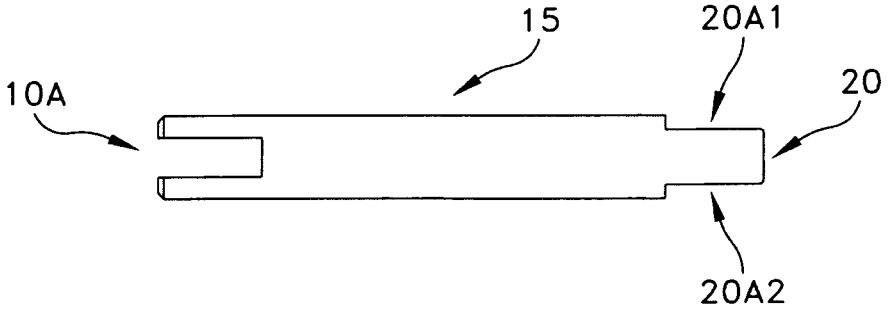
FIG. 1A (PRIOR ART)
FIG. 1A illustrates a side view of the prior art drive shaft of FIG. 1.

Referring to FIG. 1 and FIG. 1A, a prior art marine water pump drive shaft is shown and comprises a first end 10 having a slot 10A, a second end 20 having a generally rectangular pump shaft tang 20A extending outward from a rounded elongate shaft 15, elongate shaft 15 being disposed between first end 10 and second end 20. Pump shaft tang 20A includes a flat surface 20A1 and 20A2 that are stepped down from rounded elongate shaft 15. Slot 10A of first end 10 is adapted for coupling to the impellor of a water pump and pump shaft tang 20A is adapted for coupling to a marine accessory drive.

Referring to FIGS. 2 through 4, and 6A the pump shaft 2 of the present invention comprises a first end 25 having a slot 25A, a second end 30 including a flange rim 30A having an extension tang 30B extending outward therefrom. Slot 25A of first end 25 is adapted for coupling to the impellor of a water pump 90 and pump shaft tang 30B is adapted for coupling to a marine accessory drive 95.

Flange rim 30A includes a top surface 30A1, and side surfaces 30A2, 30A3 and 30A4. Extension tang 30B extends outward from flange rim 30A adjacent to and bisecting side surfaces 30A3 and 30A4. Elongate shaft 35 includes a first section 35A and a second section 35B. Shaft first section 35A extends outward from and is concentric to side surface 30A2 of flange rim 30A with the top surface 35A1 of first section 35A stepped down along its periphery from the periphery of flange rim top surface 30A1. Top surface 35B1 of second section 35B is stepped down along its periphery from top surface 35A1 of section 35A and has a reduced diameter with respect to section 35A. In the preferred embodiment, section 35A is approximately 12 mm in diameter and section 35B is approximately 1/100 mm less diameter. In the preferred embodiment section 35A extends approximately 0.75 inches out from side surface 30A2 of flange rim 30A with section 35B extending 1 inch out from section 35A. Preferably, pump shaft 2 is machined from a single piece of steel or similar material and each section described herein is in a fixed attachment to each other section. It is understood that all dimensions herein described can be varied to accommodate dimensional constraints of various water pump designs.

Figure 2:
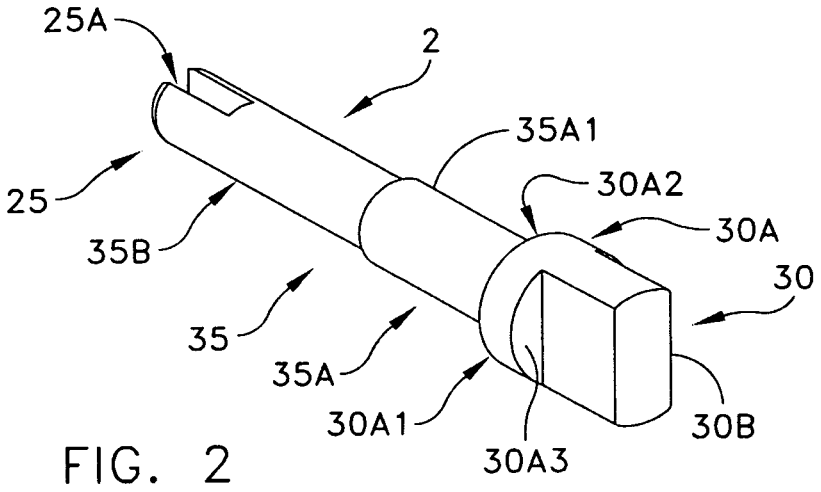
FIG. 2 illustrates a perspective view of the marine water pump drive shaft of the present invention.
Figure 3:
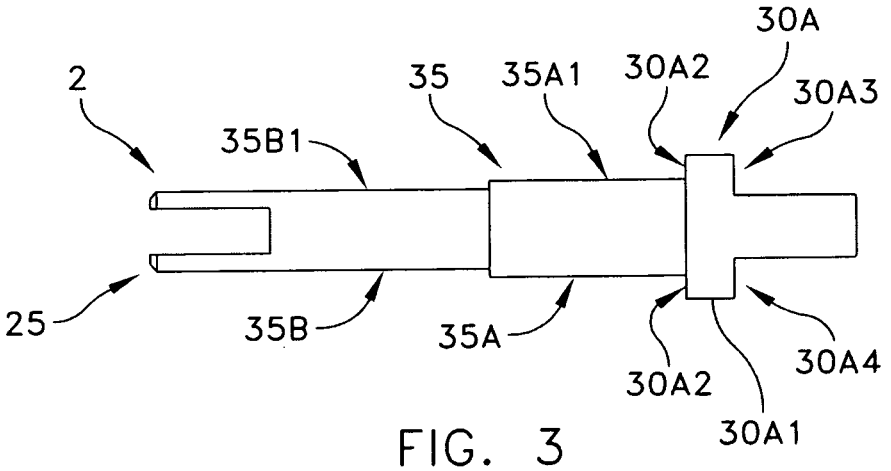
FIG. 3 illustrates a side view of the drive shaft of FIG. 2.
Figure 4:
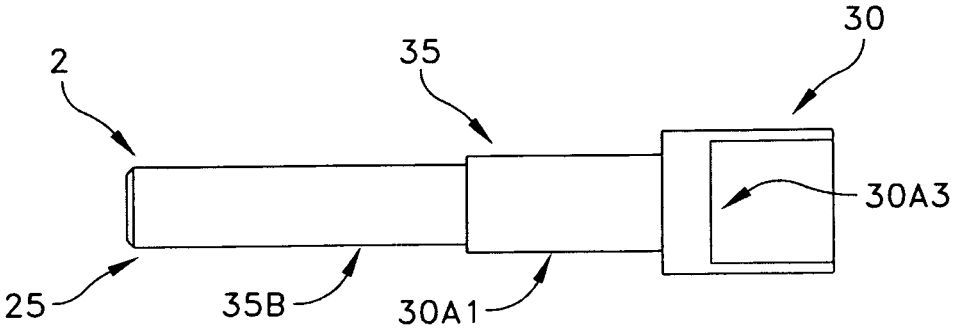
FIG. 4 illustrates a top view of the drive shaft of FIG. 2.
Figure 5:
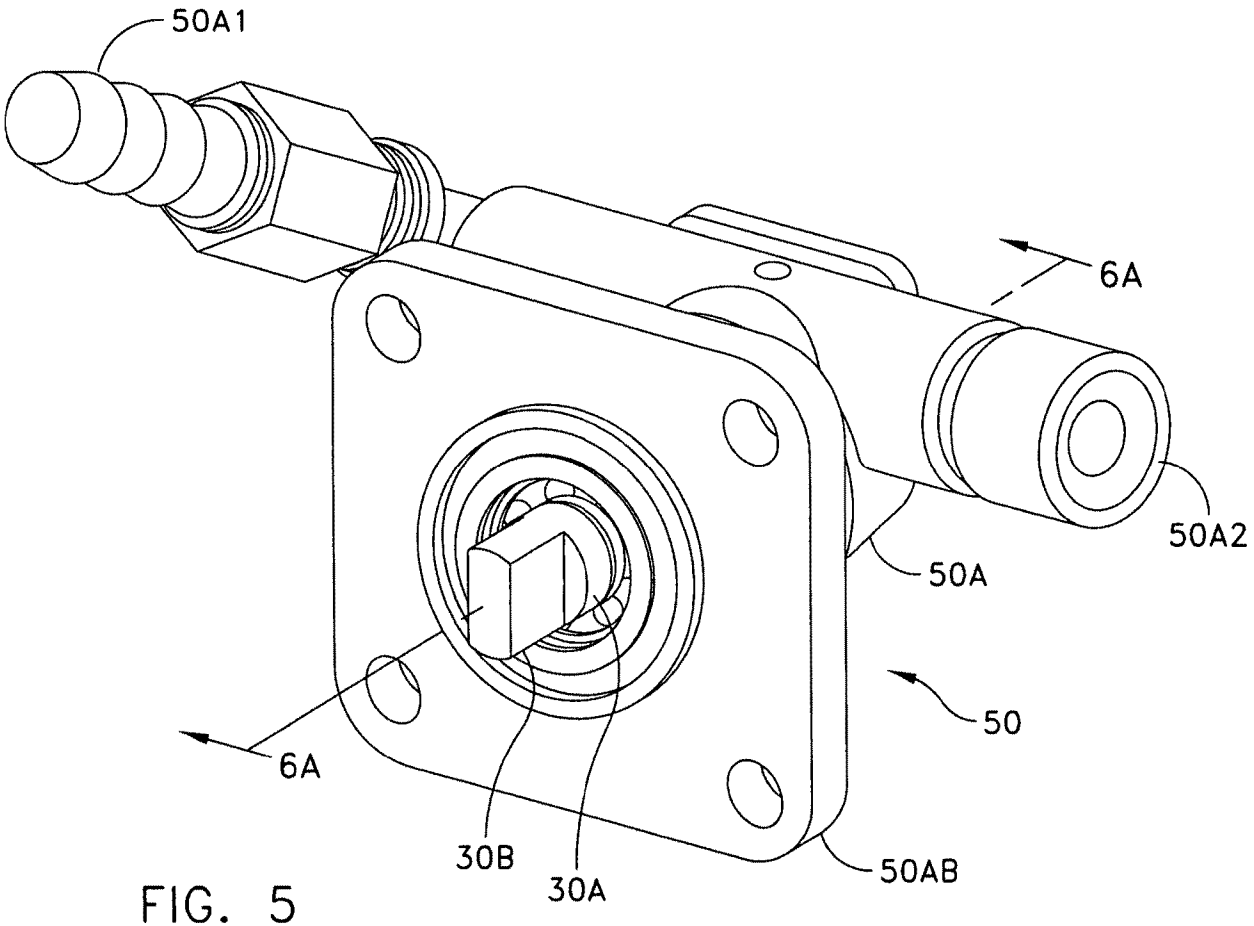
FIG. 5 illustrates a water pump assembly including the drive shaft of FIG. 2, illustrating the section of the drive shaft that would be attached to an exterior drive source.
Figure 6:
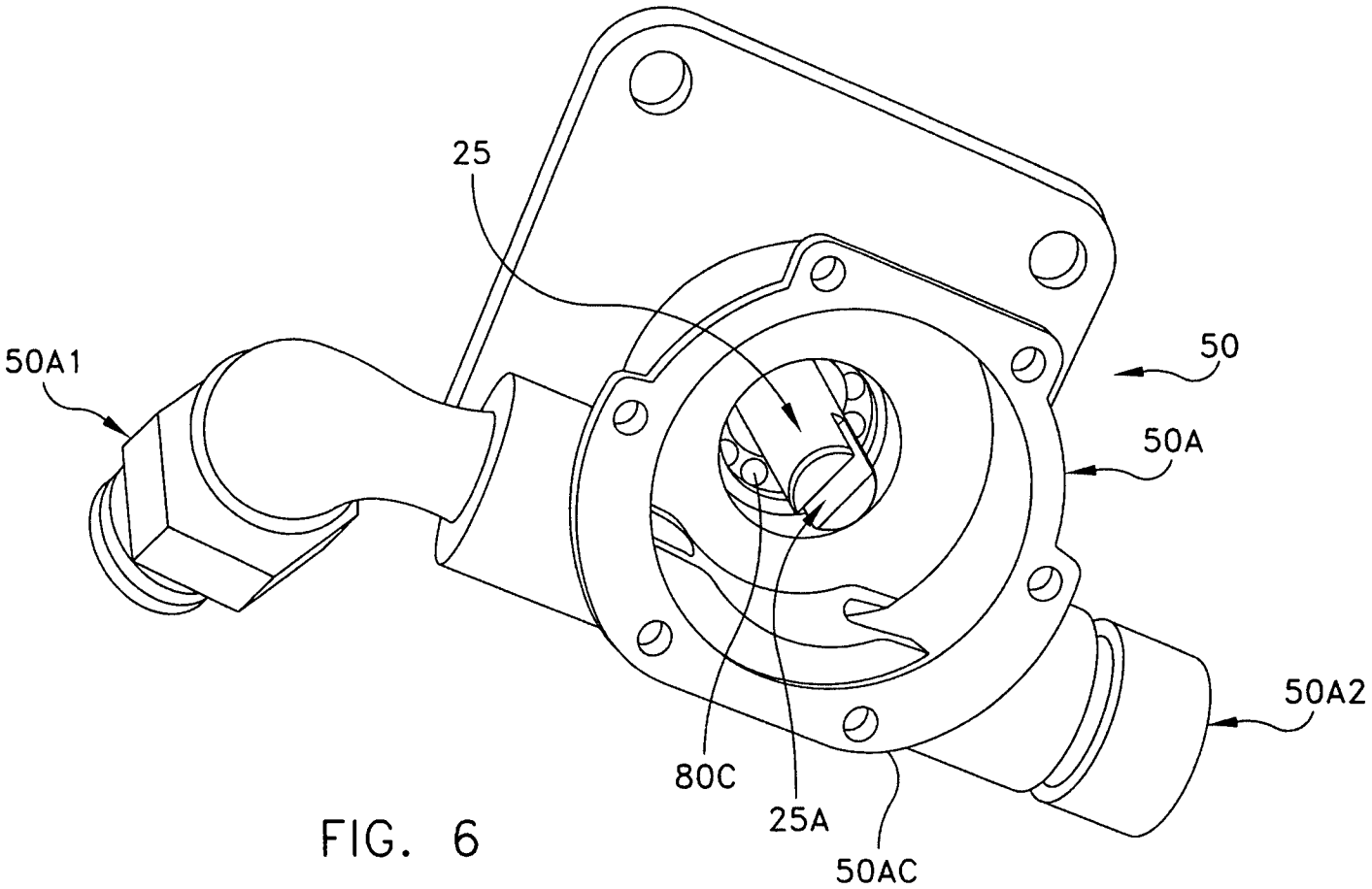
FIG. 6 illustrates a water pump assembly including the drive shaft of FIG. 2, illustrating the section of the drive shaft that would be connected to a water pump impellor.
Figure 7:
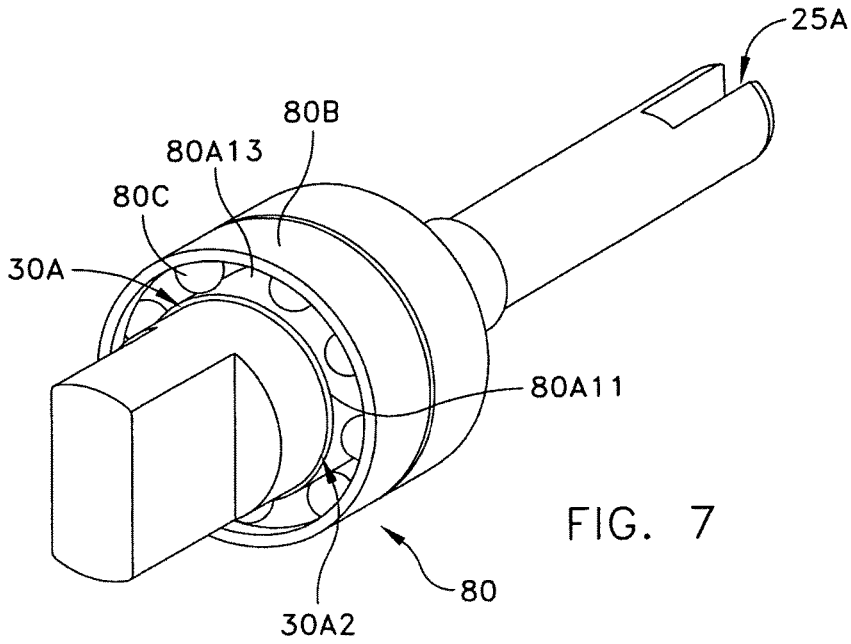
FIG. 7 illustrates the drive shaft of FIG. 2 within a water pump bearing assembly.
Figure 8:
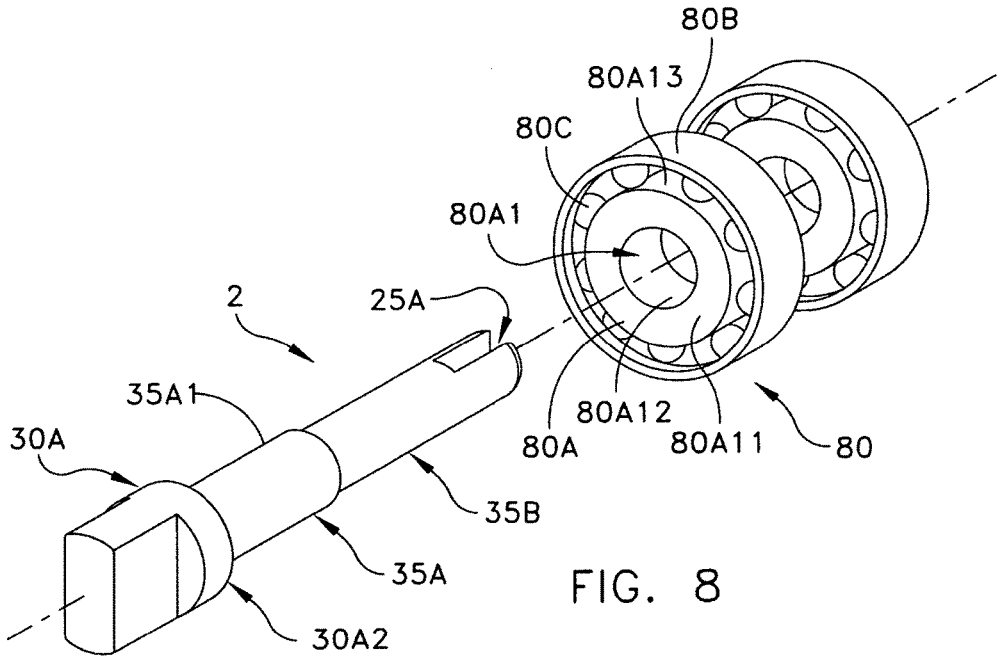
FIG. 8 illustrates the drive shaft of FIG. 2 prior to insertion within the water pump bearing assembly of FIG. 7.

Referring to FIGS. 5-8, the water pump drive shaft 2 of FIGS. 2-4, is illustrated embodied within a marine water pump bearing assembly 80 (FIG. 7, 8). FIGS. 5, 6 illustrate bearing assembly 80 and the drive shaft of FIGS. 2-4 embodied within water pump 50.

Referring to FIG. 8, a water pump bearing assembly 80 is shown and includes an internal washer 80A having a circular top surface 80A13, a concentric circular inner surface 80A 12, a planer circular side surface 80A 11 disposed between top surface 80A 13 and inner surface 80A12, the concentric inner surface 80A12 forming a bore 80A1 therethrough. The bearing assembly further includes an outer casing 80B and ball bearings 80C packed between circular top surface 80A13 and outer casing 80B. The bearing assembly allows for unrestricted rotation of washer 80A within bearing assembly 80.

It is often necessary during maintenance actions to replace a drive shaft. Referring to FIG. 8, drive shaft 2 section 35B, engages bore 80A1 freely without restriction up to the point when section 35A begins. The diameter of section 35A is such that more force is required to engage section 35A through bore 80A1 permitting a tight fit of section 35A within bore 80A1. Shaft 35 is pressed into bore 80A1 up to the point where planer side surface 30A2 of flange rim 30A contacts planer side surface 80A11 of bearing assembly 80. As illustrated in FIG. 7, after contact, shaft 2 is precisely located within bearing assembly 80 and bearing assembly 80 and shaft 2 are now ready to be placed within water pump 50. It is understood that the dimension of flange 30A is such that planer side surface 30A2 is of sufficient dimension to have contact with planer surface 80A11. In the preferred embodiment planer side surface 30A2 substantially covers planer side surface 80A11 as illustrated in FIG. 7.

Water pump 50 is used in conventional engines to circulate coolant through the engine. Conventional water pumps function as the primary mechanism for forcing the fluid to flow through the cooling system. The most common form of water pump is a mechanical centrifugal pump which utilizes a circulating impeller to force water to flow into the engine.

Figure 6A:
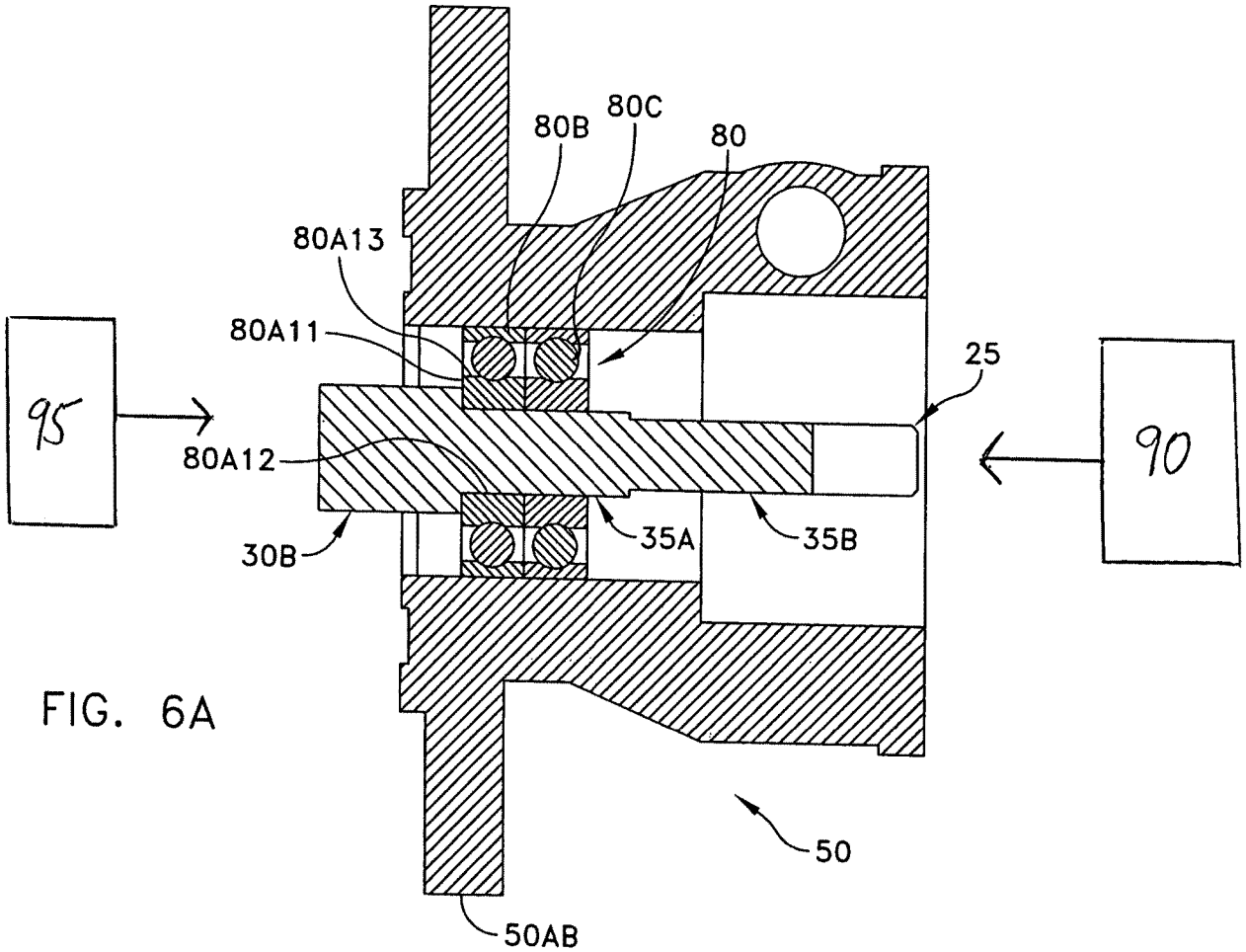
FIG. 6A illustrates a cross-sectional view of the water pump assembly of FIG. 5 including the drive shaft of FIG. 2.

Referring to FIGS. 5,6 and 6A water pump 50 includes a housing 50A, a water inlet 50A1, a water outlet 50A2, a bearing assembly 80 located within said housing 50A, a pump shaft fitted within the bearing assembly 80, the pump shaft having a first end 25 having a slot 25A, a second end 30 including a flange rim 30A having an extension tang 30B extending outward therefrom. Housing 50A is mounted to an accessory drive 95 via housing 50A mounting plate 50AB allowing for extension tang 30B to engage an accessory drive 95 for rotation of the shaft within the bearing assembly 80.

First end 25 of the pump shaft includes a slot 25A for the mounting of an impellor (not shown), the impellor used to force water into an engine, the water pump 50 being mounted to an engine via mounting plate 50AC.

It should be understood that the following is a detailed description of the invention and that numerous changes to the disclosed embodiments can be made in accordance with the disclosure herein without departing from the spirit or scope of the invention. Rather, the scope of the invention is to be determined only by the appended claims and their equivalents.

We claim:

1. A drive shaft for use within a water pump, the water pump having a circulating impeller driven by an accessory drive to force water to flow into an engine, the drive shaft comprising:

an elongate waist portion;

a first end portion at one end of said elongate waist portion, said first end portion adapted to be coupled to the impeller of the water pump;

a second end portion at the opposite end of said elongate waist portion, said second end portion disposed concentric to said first end portion, said second end portion including a flange rim, said flange rim stepped up from the surface of said second end portion, said second end portion disposed concentric to said flange rim at one side of said flange rim, said flange rim further including an extension tang, said extension tang projecting outward from said flange rim at an opposite side of said one side of said flange rim, wherein said outwardly projecting extension tang bisects said opposite side of said one side of said flange rim, said opposite side of said one side of said flange rim further including a first side surface and a second side surface, said first and second side surfaces normal to said extension tang, said extension tang adapted to be coupled to said accessory drive for circulating the impeller, and said first and second end portions being fixedly attached.

2. A drive shaft according to claim 1, wherein said second end portion is stepped up from said first end portion.

3. A drive shaft according to claim 2, wherein said second end portion is approximately 1/100 of a millimeter greater in diameter than said first end portion.

4. A drive shaft according to claim 1, wherein said extension tang is rectangular.

5. A drive shaft according to claim 1, wherein said first end portion of said elongate waist portion includes a slot portion for connecting to said impeller of said water pump.

* * * * *